US008011954B2

(12) United States Patent
Nagafuchi

(10) Patent No.: US 8,011,954 B2
(45) Date of Patent: Sep. 6, 2011

(54) SHIELDED CONNECTOR

(75) Inventor: Akihiro Nagafuchi, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 15 days.

(21) Appl. No.: 12/311,424

(22) PCT Filed: May 20, 2008

(86) PCT No.: PCT/JP2008/059167

§ 371 (c)(1), (2), (4) Date: Mar. 30, 2009

(87) PCT Pub. No.: WO2008/146645

PCT Pub. Date: Dec. 4, 2008

(65) Prior Publication Data

US 2010/0035449 A1 Feb. 11, 2010

(30) Foreign Application Priority Data

May 29, 2007 (JP) ..... 2007-141347

(51) Int. Cl.
*H01R 9/05* (2006.01)

(52) U.S. Cl. ..... 439/585

(58) Field of Classification Search ..... 439/585, 439/581, 578; 29/620

See application file for complete search history.

(56) References Cited

U.S. PATENT DOCUMENTS

| | | | | |
|---|---|---|---|---|
| 6,210,223 | B1 | 4/2001 | Aoyama et al. | |
| 6,482,034 | B2 * | 11/2002 | Ozaki | 439/585 |
| 7,494,388 | B2 * | 2/2009 | Kakuta | 439/879 |

FOREIGN PATENT DOCUMENTS

| | | |
|---|---|---|
| JP | A-2000-173725 | 6/2000 |
| JP | A-2002-270305 | 9/2002 |
| JP | A-2006-024499 | 1/2006 |

* cited by examiner

*Primary Examiner* — Alexander Gilman

(74) *Attorney, Agent, or Firm* — Oliff & Berridge, PLC

(57) ABSTRACT

Characteristic impedances of a shielded connector and a shielded cable are matched by lowering that of the connector conventionally high in a connection portion of an inner conductor terminal of the connector to a signal conductor of the cable, and transmission loss by reflection of high-frequency signals is decreased. The connector for a shielded cable W comprising a signal conductor Wa, a shielded conductor Wd, an insulator Wb interposed between the conductors Wa and Wd, and a sheath covering the conductor Wd, comprises an inner conductor terminal 2 connected to the conductor Wa, and an outer conductor terminal 4 connected to the conductor Wd to house the terminal 2 interposing a dielectric 3 between the terminals. The terminal 2 comprises a connecting section 2*a* to the conductor Wa, and a crimping portion 5 for enlarging the outer diameter of the section 2*a* is crimped onto the section 2*a* after connection.

2 Claims, 9 Drawing Sheets

SHIELDED CONNECTOR

TECHNICAL FIELD

The present invention relates to a connection of a cable such as a wiring harness to an electric device of an automobile, and specifically relates to a shielded connector to be connected to a terminal portion of a shielded cable to be connected to a printed circuit board or an antenna of the electric device.

BACKGROUND ART

In recent years, speed of electric signals (frequencies of electric signals) to be transmitted to a control printed circuit board, which is incorporated in an electric device such as a car navigation system of an automobile and on which components such as an electronic component and an IC (an integrated circuit) are mounted, has been increased. In addition, a circuit pattern on such a printed circuit board has become denser. Generally, a shielded cable is used to transmit high frequency electric signals, and along with the increase in frequencies of electric signals, a high frequency shielded connector to be connected to the shielded cable has been increasingly required.

Examples of the shielded cable include a so-called coaxial cable. A coaxial cable generally has a coaxial structure in which a signal conductor which is used as a transmission path of electric signals and is defined by a bundle of a plurality of elemental wires such as copper wires, a shielded conductor which is defined by a braided wire composed of a plurality of elemental wires, an insulator which is interposed between the conductors, and an insulating sheath which is arranged to cover the shielded conductor are concentrically arranged. The shielded conductor covers the signal conductor leaving no clearance and electromagnetically shields the signal conductor.

Generally, a shielded connector to be connected to an end of the coaxial cable which transmits high frequency electric signals is provided with an inner conductor terminal to be connected to the signal conductor which transmits high frequency electric signals, an outer conductor terminal to be connected to the shielded conductor defined by the braided wire and arranged to cover the inner conductor terminal, and a dielectric having a predetermined dielectric constant which is provided between the inner conductor terminal and the outer conductor terminal. The insulator and the sheath at the end of the coaxial cable are stripped off to expose the signal conductor and the shielded conductor, and the inner conductor terminal and the outer conductor terminal are electronically connected to the exposed signal conductor and the exposed shielded conductor respectively.

An example of a conventional shielded connector is disclosed in Japanese Patent Application Unexamined Publication No. 2000-173725. FIG. 9 is a longitudinal sectional view of the shielded connector. As shown in FIG. 9, a shielded connector 20 is connected to portions of a signal conductor Wa and a shielded conductor Wd of a coaxial cable W which are exposed by stripping off an insulator Wb and a sheath We. An inner conductor terminal 21 is connected to the signal conductor Wa via a crimp section 21*a*, and an outer conductor terminal 23 is connected to the shielded conductor Wd via a crimp section 23*a*. A dielectric 22 which brings the terminals into an insulated state is interposed between the terminals.

Generally, a characteristic impedance of a coaxial cable in the transmission of high frequency electric signals is set to be, for example, 50 ohms in order to match with a characteristic impedance of a printed circuit board of an electric device to which the coaxial cable is connected. If there is a portion such that the characteristic impedances do not match with each other (a mismatch portion) in a transmission path of high frequency electric signals, reflection of electric signals occurs in the mismatch portion, thereby causing problems such as reduction in transmission efficiency and generation of noise. Therefore, it is necessary to match the characteristic impedance of the shielded connector to the characteristic impedance of the coaxial cable.

In general, impedance matching of the characteristic impedance of the shielded connector to the characteristic impedance of the coaxial cable is obtained by adjusting "the ratio of an inside diameter of a shell portion of an outer conductor terminal to an outer diameter of a terminal section of an inner conductor terminal" and "a dielectric constant of a dielectric". As shown in FIG. 9, an outer diameter of the crimp section 21*a* of the inner conductor terminal 21 after being crimped is made to have a size and shape giving a higher priority to reliability of electrical connection with the signal conductor Wa, and is generally smaller than an outer diameter of a terminal section 21*b*. Thus, "the ratio of an inside diameter of a shell portion 23*b* of the outer conductor terminal 23 to an outer diameter of the crimp section 21*a* of the inner conductor terminal 21" at the crimp section 21*a* is not equal to "the ratio of the inside diameter of the shell portion 23*b* of the outer conductor terminal 23 to the outer diameter of the terminal section 21*b* of the inner conductor terminal 21" at the terminal section 21*b*. Therefore, the characteristic impedance in the crimp section 21*a* of the inner conductor terminal 21 does not match with the characteristic impedance of the coaxial cable W and becomes higher than it.

In a section in which the characteristic impedance of the shielded connector is not equal to the characteristic impedance of the coaxial cable, reflection or radiation of transmitted electric signals occurs, which brings about such problems that electric signals are not properly transmitted and that noise is generated. Especially in the transmission of high frequency electric signals of several gigahertzes, the problems remarkably occur.

In order to remedy the problems, the characteristic impedance at the crimp section of the inner conductor terminal is to be lowered and matched to the characteristic impedance of the coaxial cable, and impedance matching can be obtained by enlarging the outer diameter of the crimp section of the inner conductor terminal after being crimped to be the same as the outer diameter of the terminal section of the inner conductor terminal. Conventionally, a method of attaching a cylindrical metal sleeve to the crimp section is used for enlarging the outer diameter of the crimp section.

DISCLOSURE OF THE INVENTION

Problem to be Solved by the Invention

However, the method of enlarging the outer diameter of the crimp section of the inner conductor terminal by attaching the cylindrical metal sleeve to the crimp section has such a problem that the cylindrical metal sleeve should be previously fit over the exposed insulator of the coaxial cable before the crimp section of the inner conductor terminal is crimped, and the fitting work is complicated. In addition, the size of the signal conductor changes depending on the type of coaxial cable, and accordingly, the outer diameter of the crimp section of the inner conductor terminal to be crimped onto the signal conductor changes after the crimp section of the inner conductor terminal is crimped, so that the outer diameter of the metal sleeve to be fit over the exposed insulator of the coaxial cable also changes. Thus, in order to deal with many types of coaxial cables, various sizes of metal sleeves should be prepared, or the number of coaxial cables to be used should be limited to one. Accordingly, production cost of the shielded connector is increased, or general versatility of the shielded connector is lowered by limiting the number of coaxial cables.

An object of the present invention is to overcome the problems described above and to obtain impedance matching between a characteristic impedance of a shielded connector and a characteristic impedance of a shielded cable by lowering the characteristic impedance of the shielded connector which is conventionally high in a connection portion which connects an inner conductor terminal of the shielded connector to a signal conductor of the shielded cable. Another object of the present invention is to provide a shielded connector with general versatility, which does not require various types of metal sleeves in contrast to the above-described case of obtaining impedance matching by attaching a metal sleeve.

Means for Solving Problem

To achieve the objects and in accordance with the purpose of the present invention, a shielded connector for a shielded cable including a signal conductor, a shielded conductor, an insulator interposed between the signal conductor and the shielded conductor, and a sheath arranged to cover the shielded conductor includes an inner conductor terminal to be connected to the signal conductor, and an outer conductor terminal to be connected to the shielded conductor, which is arranged to house the inner conductor terminal interposing a dielectric between the outer conductor terminal and the inner conductor terminal, wherein the inner conductor terminal includes an inner conductor terminal connecting section to be connected to the signal conductor, and a connecting section crimping portion made from a plate-shaped conductive material and arranged to enlarge an outer diameter of the inner conductor terminal connecting section is crimped onto and wound around the inner conductor terminal connecting section after being connected.

It is preferable that one of terminal portions of the connecting section crimping portion is placed on the other terminal portion when the connecting section crimping portion is crimped onto the inner conductor terminal connecting section. In addition, it is preferable that terminal portions of the connecting section crimping portion are arranged to collide against each other to be bent inward when the connecting section crimping portion is crimped onto the inner conductor terminal connecting section.

It is also preferable that the connecting section crimping portion includes at one of terminal portions a ring-shaped portion being bent inward from a top side of the terminal portion and the ring-shaped portion comes into elastic contact with the inner conductor terminal connecting section when the connecting section crimping portion is crimped onto the inner conductor terminal connecting section. In addition, it is preferable that the connecting section crimping portion includes at one of terminal portions a ring-shaped portion being bent inward from a top side of the terminal portion and at the other terminal portion a ring-shaped portion being bent inward from a top side of the terminal portion and the ring-shaped portions come into elastic contact with the inner conductor terminal connecting section when the connecting section crimping portion is crimped onto the inner conductor terminal connecting section.

Effect of the Invention

Because the shielded connector has the above-described configuration in which the connecting section crimping portion made from the plate-shaped conductive material and arranged to enlarge the outer diameter of the inner conductor terminal connecting section is crimped onto and wound around the inner conductor terminal connecting section after being connected to the signal conductor, a high characteristic impedance around the inner conductor terminal connecting section after being crimped, of which the outer diameter is smaller than the outer diameter of the terminal section of the inner conductor terminal, can be lowered and matched to a characteristic impedance of the shielded cable.

In addition, because the only thing to do is to crimp and wind the connecting section crimping portion onto and around the inner conductor terminal connecting section, it is not necessary to previously fit a metal sleeve over the exposed insulator of the shielded cable in contrast to the conventional case of enlarging the outer diameter of the inner conductor terminal connecting section by attaching a metal sleeve to the inner conductor terminal connecting section, and workability of enlarging the outer diameter of the inner conductor terminal connecting section is improved. In addition, it is not necessary to prepare various types of metal sleeves in contrast to the conventional case of obtaining impedance matching by attaching a metal sleeve as described above, and various types of shielded cables can be dealt with.

By the configuration in which one of the terminal portions of the connecting section crimping portion is placed on the other terminal portion when the connecting section crimping portion is crimped onto the inner conductor terminal connecting section, the outer diameter of the connecting section crimping portion after being crimped can be made smaller. In addition, by the configuration in which the terminal portions of the connecting section crimping portion collide against each other to be bent inward when the connecting section crimping portion is crimped onto the inner conductor terminal connecting section, the outer diameter of the connecting section crimping portion after being crimped can be made larger.

In addition, by the configuration in which the connecting section crimping portion includes at one of the terminal portions the ring-shaped portion being bent inward from the top side of the terminal portion and the ring-shaped portion comes into elastic contact with the inner conductor terminal connecting section when the connecting section crimping portion is crimped onto the inner conductor terminal connecting section, or the configuration in which the connecting section crimping portion includes at one of the terminal portions the ring-shaped portion being bent inward from the top side of the terminal portion and at the other terminal portion the ring-shaped portion being bent inward from the top side of the terminal portion and the ring-shaped portions come into elastic contact with the inner conductor terminal connecting section when the connecting section crimping portion is crimped onto the inner conductor terminal connecting section, it becomes easy to set the outer diameter of the connecting section crimping portion after being crimped to have a predetermined size.

In the conventional method of enlarging the outer diameter of the inner conductor terminal connecting section by attaching a metal sleeve to the inner conductor terminal connecting section, it is necessary to prepare various sizes of metal sleeves in order to deal with various types of shielded cables. In contrast, according to the preferred embodiments of the present invention, it is possible to make the outer diameter of the connecting section crimping portion after being crimped larger or smaller only by changing the crimping method of the connecting section crimping portion and thus obtain impedance matching in various types of shielded connectors and shielded cables.

BRIEF DESCRIPTION OF THE DRAWINGS

FIGS. 2A to 2C are views showing the process of connecting by crimping a signal conductor of a coaxial cable to a crimp section of an inner conductor terminal of the shielded connector shown in FIG. 1, in which FIG. 2A is a transverse sectional view of the crimp section of the inner conductor terminal before being crimped and the signal conductor of the coaxial cable, FIG. 2B is a transverse sectional view of the crimp section of the inner conductor terminal after being crimped and the signal conductor of the coaxial cable, and FIG. 2C is a longitudinal sectional view of the inner conductor terminal after being crimped and the signal conductor of the coaxial cable;

FIGS. 3A to 3C are views showing the process of connecting by crimping a connecting section crimping portion to the crimp section of the inner conductor terminal after being crimped shown in FIGS. 2A to 2C, in which FIG. 3A is a transverse sectional view of the crimp section of the inner conductor terminal after being crimped and the connecting section crimping portion before being crimped, FIG. 3B is a transverse sectional view of the crimp section of the inner conductor terminal after being crimped and the connecting section crimping portion after being crimped, and FIG. 3C is a longitudinal sectional view of the crimp section of the inner conductor terminal after being crimped and the connecting section crimping portion after being crimped;

FIGS. 5A to 5C are views showing the process of connecting by crimping a connecting section crimping portion to a crimp section of an inner conductor terminal after being crimped of the shielded connector shown in FIG. 4, in which FIG. 5A is a transverse sectional view of the crimp section of the inner conductor terminal after being crimped and the connecting section crimping portion before being crimped, FIG. 5B is a transverse sectional view of the crimp section of the inner conductor terminal after being crimped and the connecting section crimping portion after being crimped, and FIG. 5C is a longitudinal sectional view of the crimp section of the inner conductor terminal after being crimped and the connecting section crimping portion after being crimped;

FIGS. 7A to 7C are views showing the process of connecting by crimping a connecting section crimping portion to a crimp section of an inner conductor terminal after being crimped of the shielded connector shown in FIG. 6, in which FIG. 7A is a transverse sectional view of the crimp section of the inner conductor terminal after being crimped and the connecting section crimping portion before being crimped, FIG. 7B is a transverse sectional view of the crimp section of the inner conductor terminal after being crimped and the connection portion crimping portion after being crimped, and FIG. 7C is a longitudinal sectional view of the crimp section of the inner conductor terminal after being crimped and the connecting section crimping portion after being crimped;

FIGS. 8A to 8C are views showing a modified example of the process of crimping shown in FIGS. 7A to 7C, in which FIG. 8A is a transverse sectional view of the crimp section of the inner conductor terminal after being crimped and the connecting section crimping portion before being crimped, FIG. 8B is a transverse sectional view of the crimp section of the inner conductor terminal after being crimped and the connector portion crimping portion after being crimped, and FIG. 8C is a longitudinal sectional view of the crimp section of the inner conductor terminal after being crimped and the connector portion crimping portion after being crimped.

BEST MODE FOR CARRYING OUT THE INVENTION

Figure 1:
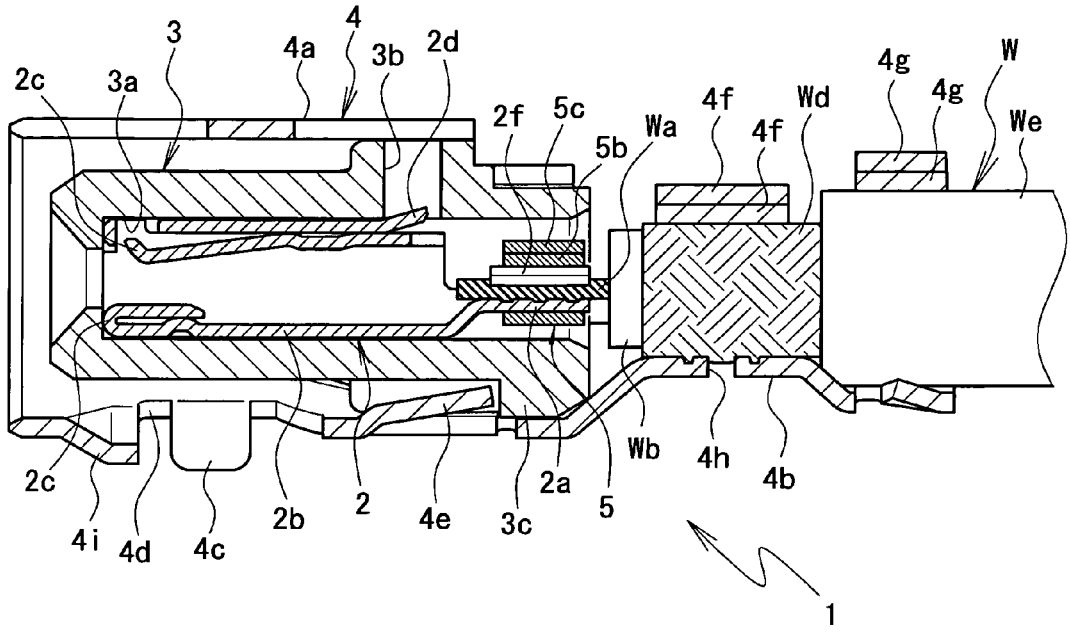
FIG. 1 is a longitudinal sectional view of a shielded connector according to a first preferred embodiment of the present invention.
Figure 2A:
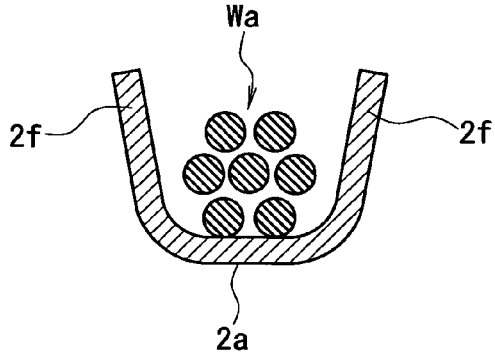
Figure 2B:
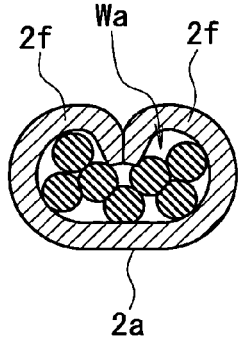
Figure 2C:
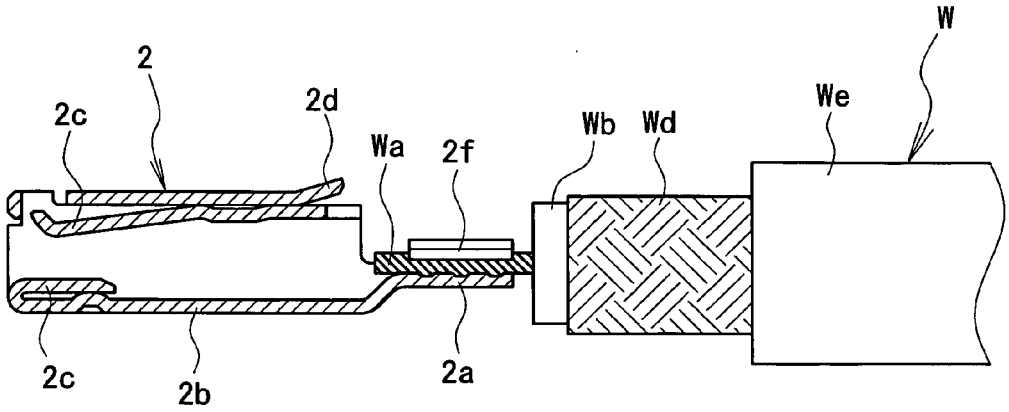
Figure 3A:
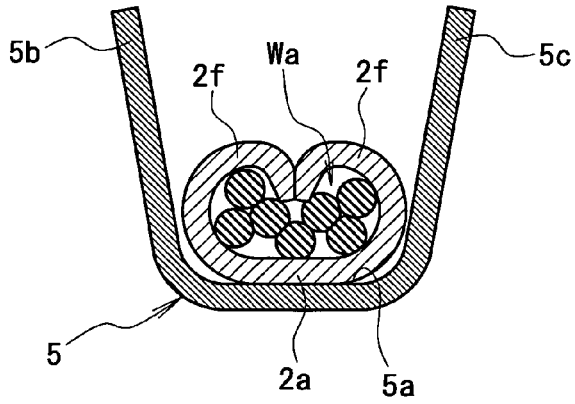
Figure 3B:
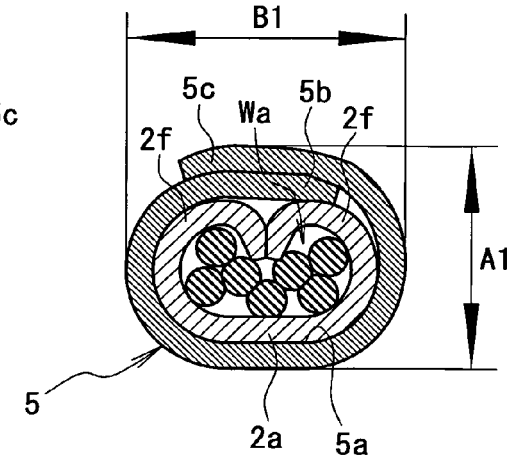
Figure 3C:
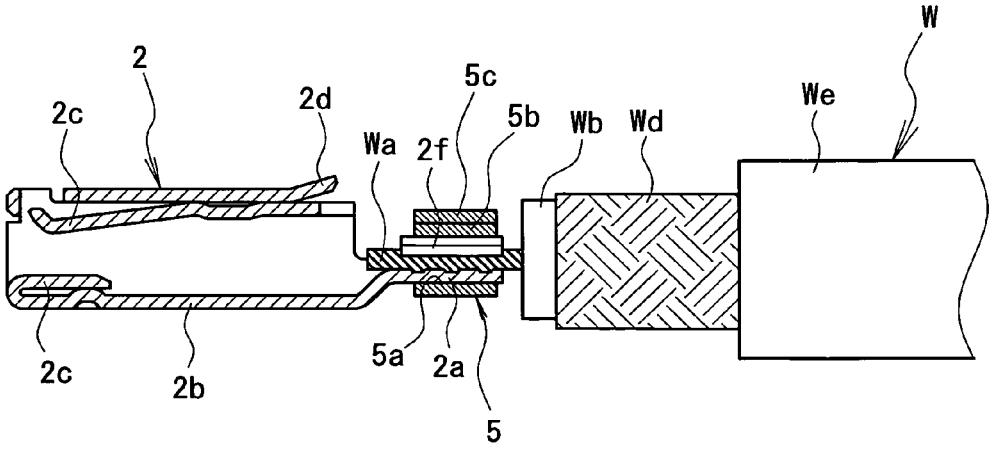

A detailed description of a shielded connector according to preferred embodiments of the present invention will now be given with reference to FIGS. 1 to 9. First, a description of a shielded connector according to a first preferred embodiment of the present invention will be given with reference to FIGS. 1 to 3C. FIG. 1 is a longitudinal sectional view of the shielded connector being connected to a coaxial cable. FIGS. 2A to 2C are views showing the process of crimping a crimp section of an inner conductor terminal onto a signal conductor. FIGS. 3A to 3C are views showing the process of crimping a connecting section crimping portion onto the crimp section of the inner conductor terminal being connected to the signal conductor. In the following descriptions, the connected side of the shielded connector to a counterpart connector not shown is referred to as a front side.

As shown in FIG. 1, a shielded connector 1 has a configuration such that, at an end of a coaxial cable W, an inner conductor terminal 2 is connected to a signal conductor Wa of the coaxial cable W, a dielectric 3 holds the inner conductor terminal 2, an outer conductor terminal 4 incorporates the dielectric 3, and the outer conductor terminal 4 is connected to a shielded conductor Wd of the coaxial cable W.

The coaxial cable W has a coaxial structure in which the signal conductor Wa which is used as a transmission path of electric signals and is defined by a bundle of a plurality of elemental wires such as copper wires, the shielded conductor Wd which consists of a braided wire composed of a plurality of elemental wires, an insulator Wb which is interposed between the conductors, and an insulating sheath We which is arranged to cover the shielded conductor Wd are concentrically arranged. The shielded conductor Wd covers the signal conductor Wa leaving no clearance and electromagnetically shields the signal conductor Wa.

As shown in FIG. 1, the coaxial cable W is prepared such that the sheath We is stripped off over a predetermined length to expose the shielded conductor Wd, the exposed shielded conductor Wd is stripped off over a predetermined length to expose the insulator Wb, and the exposed insulator Wb is stripped off over a predetermined length to expose the signal conductor Wa.

The inner conductor terminal 2 of the shielded connector 1 to be connected to the signal conductor Wa is a unitary formed member prepared by bending a plate-shaped conductive material to have a so-called female terminal shape, and has on its back side a crimp section 2*a* that defines a connecting section to the signal conductor Wa and on its front side a terminal section 2*b* to be connected to a male inner conductor terminal of a counterpart connector not shown.

The terminal section 2*b* has a pair of elastic terminal portions 2*c* and 2*c* which are bent inward. The elastic terminal portions 2*c* and 2*c* are formed to be elastically deformable, and when a tab portion of the male inner conductor terminal of the counterpart connector not shown is inserted between the elastic terminal portions 2*c* and 2*c*, the elastic terminal portions 2*c* and 2*c* come into elastic contact with the tab portion, enabling sending and receiving signals. A lock portion 2*d* provided above the terminal section 2*b* is formed to project upward and be deformable.

The dielectric 3 which holds the inner conductor terminal 2 is a unitary formed member substantially in the shape of a cylindrical column which is made from an insulative synthetic resin having a predetermined dielectric constant, and brings the inner conductor terminal 2 and the outer conductor terminal 4 into an insulated state. In the dielectric 3, a terminal housing chamber 3*a* is formed to run through the dielectric 3 in the longitudinal direction, and the inner conductor terminal 2 is held in the terminal housing chamber 3*a*. On the upper wall of the terminal housing chamber 3*a* on the back side, a locking hole 3*b* is formed. The locking hole 3*b* locks the lock portion 2*d* of the inner conductor terminal 2 to prevent the inner conductor terminal 2 from being easily pulled out of the terminal housing chamber 3*a*. On the lower wall of the dielectric 3 on the back side, a locking projection 3*c* is formed to project downward.

The outer conductor terminal 4 which incorporates the dielectric 3 is a unitary formed member prepared by bending a plate-shaped conductive material and has on its front side a shell portion 4*a* substantially in the shape of a cylinder into which the dielectric 3 is incorporated and on its back side a crimp section 4*b* which is fixed to the coaxial cable W by crimping.

On the lower wall of the shell portion 4*a* on the front side, a stabilizer 4*c* is formed to project downward. When the stabilizer 4*c* is housed in a connector housing not shown, the stabilizer 4*c* is inserted into a slit formed on the lower wall of the connector housing. The stabilizer 4*c* controls the direction of inserting the outer conductor terminal 4 into the connector housing. On the front side of an opening 4*d* formed by the formation of the stabilizer 4, a tapered guide portion 4*i* is formed. The tapered guide portion 4*i* guides the stabilizer 4*c* to the slit on the lower wall of the connector housing when the outer conductor terminal 4 is inserted into the connector housing.

On the lower wall of the shell portion 4*a* on the back side, a lock portion 4*e* is formed so as to be deformable upward. The lock portion 4*e* engages with the locking projection 3*c* projecting downward on the lower wall of the dielectric 3 on the back side. When the dielectric 3 is inserted into the shell portion 4*a* of the outer conductor terminal 4 from the front side, the dielectric 3 can be held in the shell portion 4*a* so as not to be easily pulled out therefrom. On each of the side walls of the shell portion 4*a*, a terminal portion shaped like a tongue is formed (not shown). The terminal portions come into elastic contact with the outer conductor terminal of the counterpart connector.

The crimp section 4*b* of the outer conductor terminal 4 is formed to be stepwise so that an end of the shielded conductor Wd and an end of the sheath We of the coaxial cable W are properly placed on the crimp section 4*b*. In the crimp section 4*b*, a pair of shielded conductor crimping portions 4*f* and 4*f* shaped like a strip and a pair of sheath crimping portions 4*g* and 4*g* shaped like a strip are formed to extend from the lower wall of the crimp section 4*b*. These crimping portions are long enough to be wound around various coaxial cables.

In the middle of the lower wall of the crimp section 4*b* on which the end of the shielded conductor Wd is placed, a through hole 4*h* is formed. When the shielded conductor crimping portions 4*f* and 4*f* are crimped onto the end of the shielded conductor Wd, a part of the shielded conductor Wd is embedded in the through hole 4*h*.

A connecting section crimping portion 5 is crimped onto and wound around the crimp section 2*a* of the inner conductor terminal 2 of the shielded connector 1 having the configuration as described above so as to cover the crimp section 2*a* after being crimped onto the signal conductor Wa. The connecting section crimping portion 5 is prepared by punching a plate-shaped conductive material to be shaped like a strip having a predetermined length. The connecting section crimping portion 5 is brought into conduction and connection with the crimp section 2*a*, by which an outer diameter of the crimp section 2*a* is electrically enlarged.

Next, descriptions of the process of crimping the crimp section 2*a* of the inner conductor terminal 2 onto the end of the signal conductor Wa and the process of crimping the connector portion crimping portion 5 onto the crimp section 2*a* of the inner conductor terminal 2 after being crimped will be given. FIGS. 2A to 2*c* are views showing the process of crimping the crimp section 2*a* of the inner conductor terminal 2 onto the end of the signal conductor Wa. As shown in FIGS. 2A to 2*c*, the crimp section 2*a* of the inner conductor terminal 2 is provided with a pair of shielded conductor crimping portions 2*f* and 2*f* shaped like a strip which are formed to extend from a bottom surface of the crimp section 2*a* on which the end of the signal conductor Wa of the coaxial cable W is placed. The space between the shielded conductor crimping portions 2*f* and 2*f* is broadened upward toward their ends, and the shielded conductor crimping portions 2*f* and 2*f* are long enough to be wound around various diameter signal conductors of coaxial cables.

First, as shown in FIG. 2A, the end of the signal conductor Wa is placed on the bottom wall of the crimp section 2*a* of the inner conductor terminal 2. Then, the shielded conductor crimping portions 2*f* and 2*f* are bent inward by performing crimping thereon with a crimping device not shown, and brought into a state as shown in FIGS. 2B and 2C. Thus, the inner conductor terminal 2 is brought into conduction and connection with the signal conductor Wa via the crimp section 2*a*.

Then, the connecting section crimping portion 5 is crimped onto and wound around the crimp section 2*a* of the inner conductor terminal 2 in such a state. FIGS. 3A to 3C are views showing the process of crimping the connecting section crimping portion 5 onto the crimp section 2*a* of the inner conductor terminal 2 after being crimped. As shown in FIG. 3A, the space between right and left terminal portions 5*b* and 5*c* of the connecting section crimping portion 5 is broadened from a bottom surface 5*a* of the connecting section crimping portion 5 toward their ends, and the terminal portions 5*b* and 5*c* are long enough to be wound around various diameter crimp sections of inner conductor terminals after being crimped.

First, as shown in FIG. 3A, the crimp section 2*a* of the inner conductor terminal 2 after being crimped is placed on the bottom surface 5*a* of the connecting section crimping portion 5. Then, the terminal portions 5*b* and 5*c* are bent inward by performing crimping thereon with a crimping device not shown, and brought into a state as shown in FIGS. 3B and 3C. In this case, the connecting section crimping portion 5 is crimped such that the right terminal portion 5*c* is placed on the left terminal portion 5*b*. The connecting section crimping portion 5 after being crimped has a substantially ellipse shape in cross section having a height A1 and a width B1 as shown in FIG. 3B.

The outer diameter of the crimp section 2*a* is enlarged by crimping and winding the connecting section crimping portion 5 onto and around the crimp section 2*a* of the inner conductor terminal 2 after being crimped as described above. Thus, a high characteristic impedance around the crimp section 2*a* after being crimped, of which the outer diameter is smaller than an outer diameter of the terminal section 2*b* of the inner conductor terminal 2, can be lowered and matched to characteristic impedances of the coaxial cable W and other portions than the crimp section 2*a* of the shielded connector 1.

In addition, because the outer diameter of the crimp section 2*a* of the inner conductor terminal 2 can be enlarged only by crimping the connecting section crimping portion 5 onto the crimp section 2*a* after being crimped, it is not necessary to previously fit a metal sleeve over the exposed insulator Wb of the coaxial cable W in contrast to the conventional case of enlarging the outer diameter of the crimp section 2*a* by attaching a metal sleeve, and workability of enlarging the outer diameter of the crimp section 2*a* of the inner conductor terminal 2 is improved.

Figure 4:
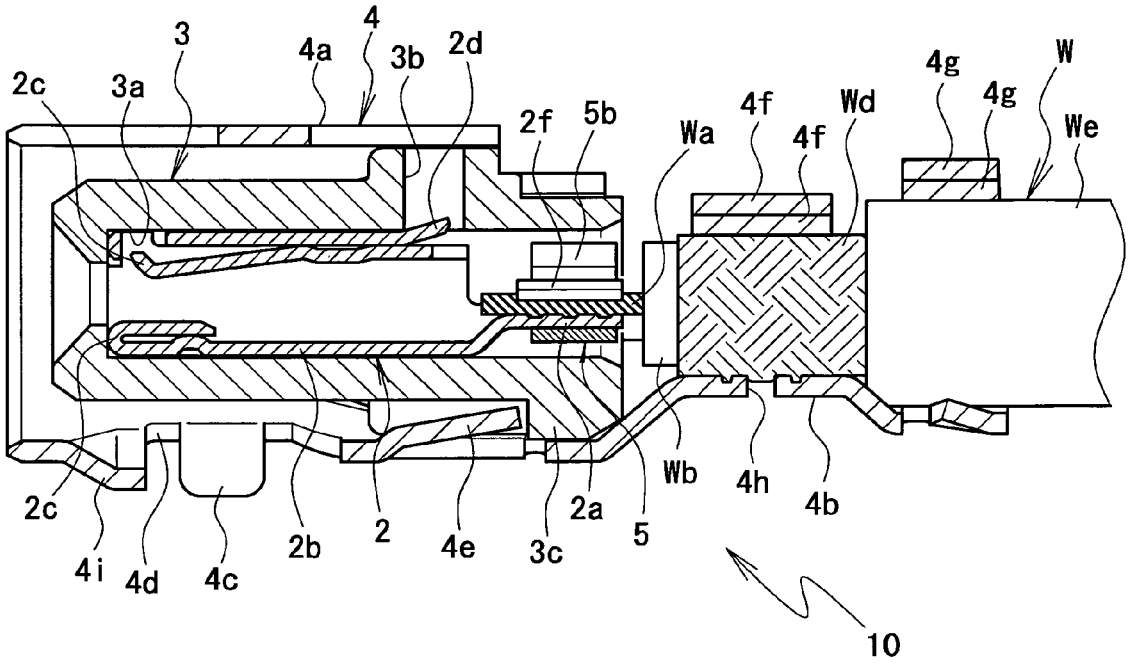
FIG. 4 is a longitudinal sectional view of a shielded connector according to a second preferred embodiment of the present invention.
Figure 5A:
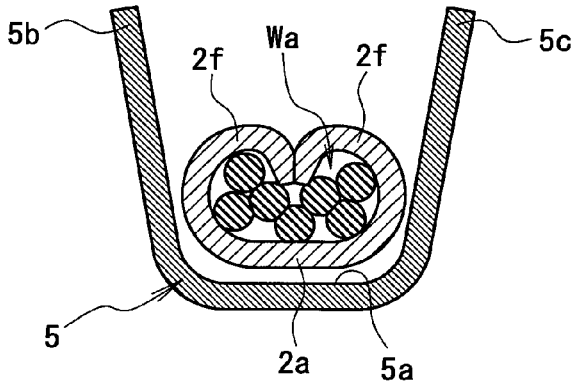

Next, a description of a shielded conductor according to a second preferred embodiment of the present invention will be given with reference to FIGS. 4 to 5C. FIG. 4 is a longitudinal sectional view of the shielded connector being connected to a coaxial cable. FIGS. 5A to 5C are views showing the process of crimping a connecting section crimping portion onto a crimp section of an inner conductor terminal being connected to a signal conductor. The same elements as the shielded connector according to the first preferred embodiment of the present invention are assigned the same reference numerals, descriptions thereof are omitted, and different respects are mainly described.

As shown in FIG. 4, a shielded connector 10 is different from the shielded connector 1 shown in FIG. 1 in that the connecting section crimping portion 5 to be crimped onto and wound around the crimp section 2*a* of the inner conductor terminal 2 after being crimped has an outer diameter different from an outer diameter of the connecting section crimping portion 5 shown in FIG. 1.

A description of the process of crimping the connecting section crimping portion 5 having the different outer diameter from the outer diameter of the connecting section crimping portion 5 shown in FIG. 1 will be given. First, as shown in FIG. 5*a*, the crimp section 2*a* of the inner conductor terminal 2 after being crimped is placed on the bottom surface 5*a* of the connecting section crimping portion 5. Then, the terminal portions 5*b* and 5*c* are bent inward by performing crimping thereon with a crimping device not shown, and brought into a state as shown in FIGS. 5B and 5C.

Figure 5B:
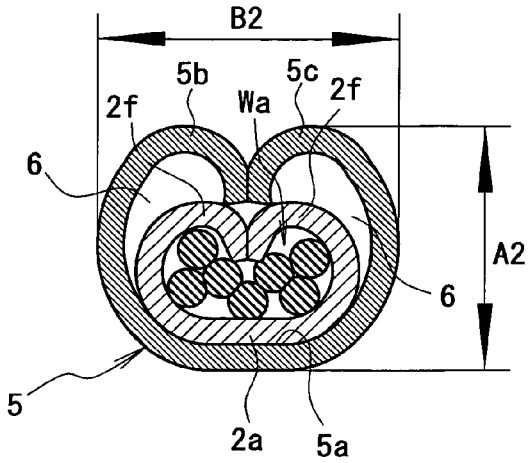
Figure 5C:
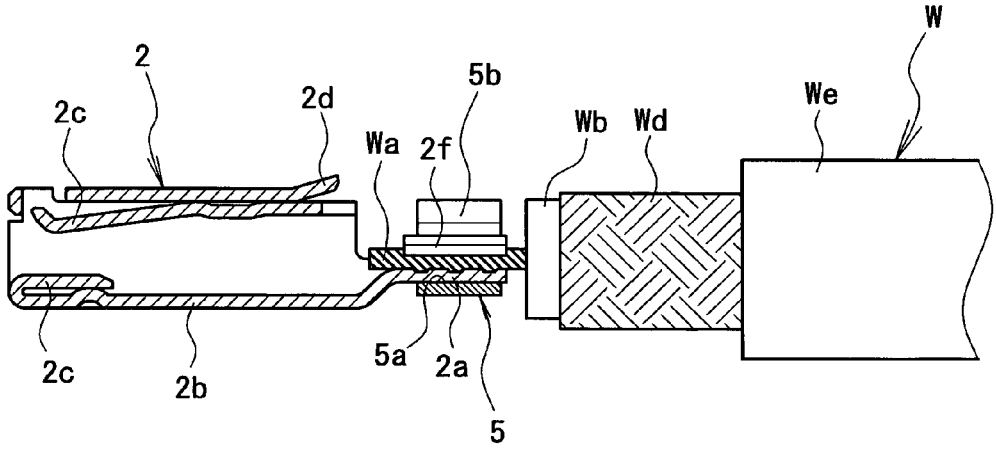

In this case, the right terminal portion 5*c* and the left terminal portion 5*b* collide against each other to be bent inward, spaces 6 and 6 are provided between the terminal portions 5*b* and 5*c* and the crimp section 2*a* of the inner conductor terminal 2 after being crimped, and the connecting section crimping portion 5 after being crimped has a substantially heart shape in cross section having a height A2 and a width B2 as shown in FIG. 5B. The height A2 and the width B2 in cross section of the connecting section crimping portion 5 after being crimped are larger than the height A1 and the width B2 in cross section of the connecting section crimping portion 5 after being crimped shown in FIG. 3B, and the outer diameter of the crimp section 2*a* of the inner conductor terminal 2 after being crimped is enlarged to be closer to the outer diameter of the terminal section 2*b* of the inner conductor terminal 2 shown in FIG. 5C.

As described above, the outer diameter (the height A1 and the width B1) of the connection portion crimping portion 5 after being crimped can be made smaller (see FIG. 3B) by crimping the connecting section crimping portion 5 such that the terminal portion 5*c* is placed on the terminal portion 5*b* when the connecting section crimping portion 5 is crimped onto and wound around the crimp section 2 of the inner conductor terminal 2 after being crimped, and the outer diameter (the height A2 and the width B2) of the connecting section crimping portion 5 after being crimped can be made larger (see FIG. 5B) by crimping the connecting section crimping portion 5 such that the terminal portion 5*b* and the terminal portion 5*c* collide against each other to be bent inward when the connecting section crimping portion 5 is crimped onto and wound around the crimp section 2 of the inner conductor terminal 2 after being crimped. In other words, only by preparing one connecting section crimping portion 5 made of a plate-shaped conductive material and changing the method of crimping the connecting section crimping portion 5 onto the crimp section 2*a* of the inner conductor terminal 2 after being crimped, the outer diameter of the connecting section crimping portion 5 after being crimped can be made smaller or larger.

In the conventional method of attaching a metal sleeve to the crimp section 2*a* of the inner conductor terminal 2 after being crimped in order to enlarge the outer diameter of the crimp section 2*a*, it is necessary to prepare metal sleeves of various sizes. In contrast, according to the preferred embodiments of the present invention, it is possible to obtain impedance matching for various types of shielded connectors and shielded cables by preparing one connecting section crimping portion 5 made of a plate-shaped conductive material.

Figure 6:
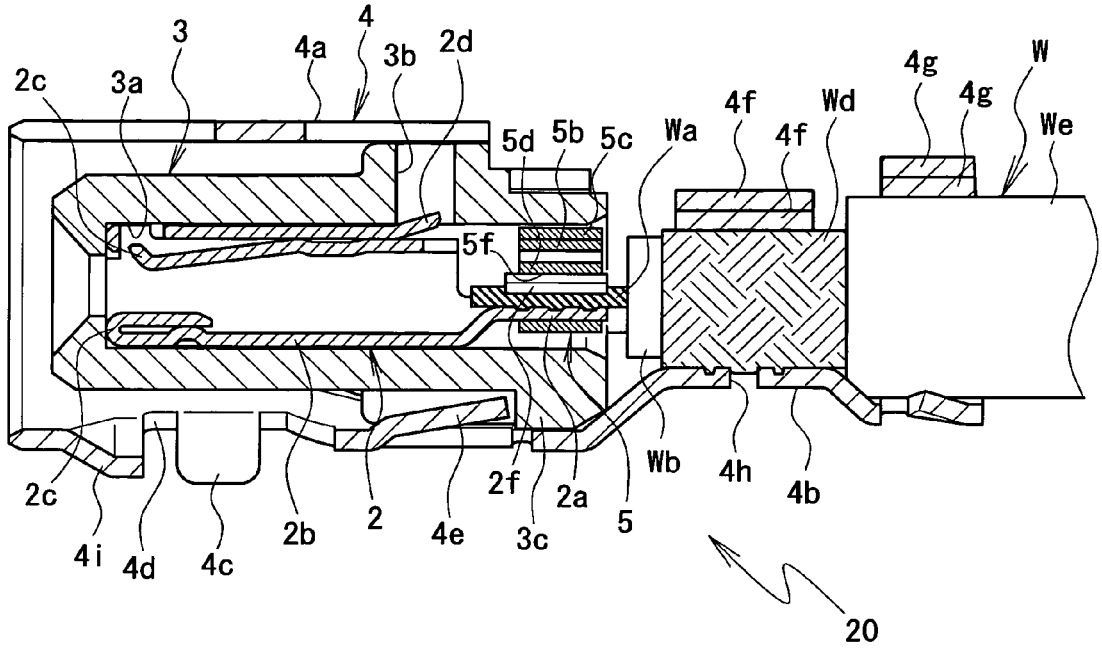
FIG. 6 is a longitudinal sectional view of a shielded connector according to a third preferred embodiment of the present invention.

Next, a description of a shielded conductor according to a third preferred embodiment of the present invention will be given with reference to FIGS. 6 to 7C. FIG. 6 is a longitudinal sectional view of the shielded connector being connected to a coaxial cable. FIGS. 7A to 7C are views showing the process of crimping a connecting section crimping portion onto a crimp section of an inner conductor terminal being connected to a signal conductor. The same elements as the shielded connector according to the first preferred embodiment of the present invention are assigned the same reference numerals, descriptions thereof are omitted, and different respects are mainly described.

As shown in FIG. 6, a shielded connector 20 is different from the shielded connector 1 shown in FIG. 1 and from the shielded connector 10 shown in FIG. 4 in that the outer diameter of the connecting section crimping portion 5 which is crimped onto and wound around the crimp section 2*a* of the inner conductor terminal 2 after being crimped is different from those shown in FIGS. 1 and 4.

Figure 7A:
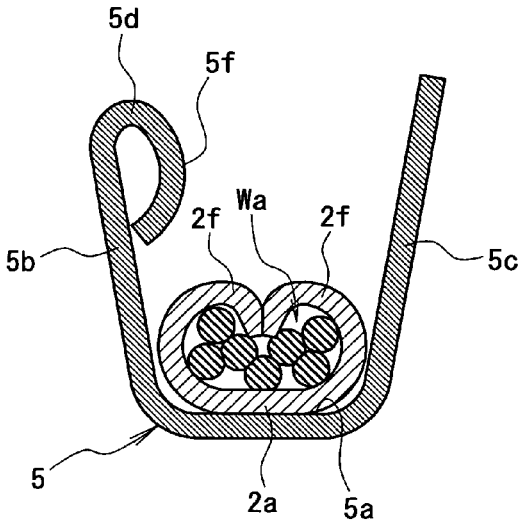

As shown in FIG. 7A, the space between the left and right terminal portions 5*b* and 5*c* of the connecting section crimping portion 5 is broadened upward from the bottom surface 5*a* of the connecting section crimping portion 5 toward their ends, and the terminal portions 5*b* and 5*c* are long enough to be wound around various diameter crimp sections of inner conductor terminals after being crimped. In this case, a ring-shaped portion 5*d* is previously formed by inwardly bending the end of the terminal portion 5*b* as shown in FIG. 7A, and a curved convex surface 5*f* is formed on an inner side of the ring-shaped portion 5*d*.

A description of the process of crimping the connecting section crimping portion 5 having the different outer diameter from those in FIGS. 1 and 4 will be given. First, as shown in FIG. 7A, the crimp section 2*a* of the inner conductor terminal 2 after being crimped is placed on the bottom surface 5*a* of the connecting section crimping portion 5. Then, the terminal portions 5*b* and 5*c* are bent inward by performing crimping thereon with a crimping device not shown, and brought into a state as shown in FIGS. 7B and 7C. At that time, the terminal portion 5*c* is placed on the terminal portion 5*b* having the ring-shaped portion 5*d*, and the curved convex surface 5*f* of the ring-shaped portion 5*d* of the terminal portion 5*b* comes into elastic contact with the crimp section 2*a* of the inner conductor terminal 2.

Figure 7B:
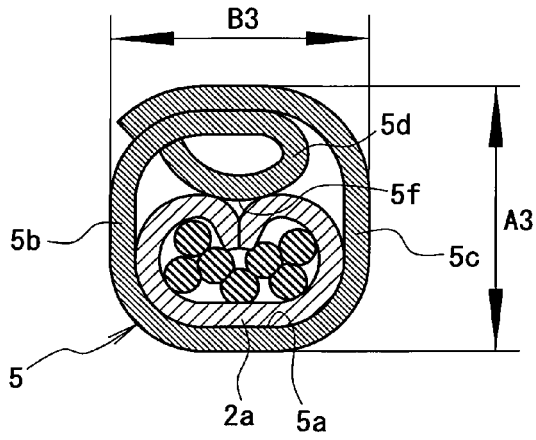

In this case, the connecting section crimping portion 5 after being crimped has a substantially ellipse shape in cross section having a height A3 and a width B3 as shown in FIG. 7B. The height A3 and the width B3 in cross section of the connecting section crimping portion 5 after being crimped are larger than the height A2 and the width B2 in cross section of the connecting section crimping portion 5 after being crimped shown in FIG. 5B according to the second preferred embodiment of the present invention, and the outer diameter of the crimp section 2*a* of the inner conductor terminal 2 after being crimped is enlarged to be closer to the outer diameter of the terminal section 2*b* of the inner conductor terminal 2 shown in FIG. 7C.

Thus, the outer diameter of the connecting section crimping portion 5, which is used to enlarge the outer diameter of the crimp section 2*a* of the inner conductor terminal 2 to be connected to the signal conductor Wa, can be set according to the size of the ring-shaped portion 5*d*. Therefore, it is not necessary to prepare various types of metal sleeves in contrast to the conventional case of obtaining impedance matching by attaching a metal sleeve, and various types of shielded wires can be dealt with.

Figure 7C:
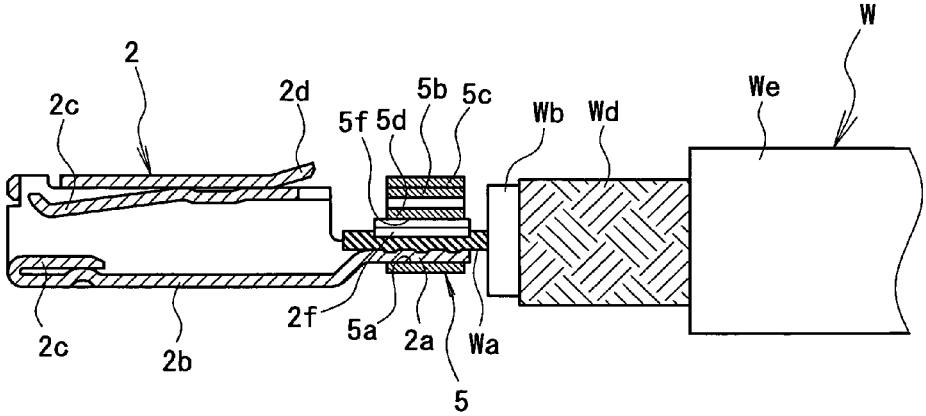
Figure 8A:
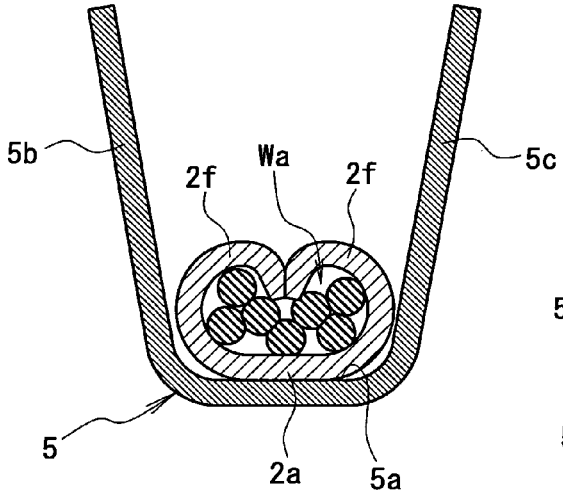
Figure 8B:
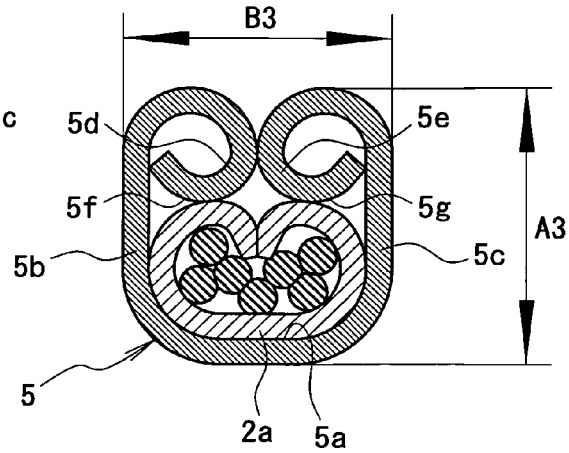
Figure 8C:
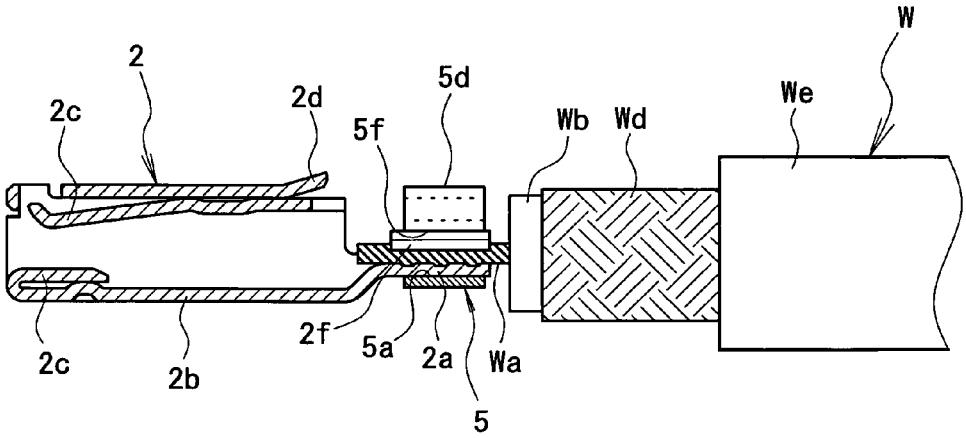
Figure 9:
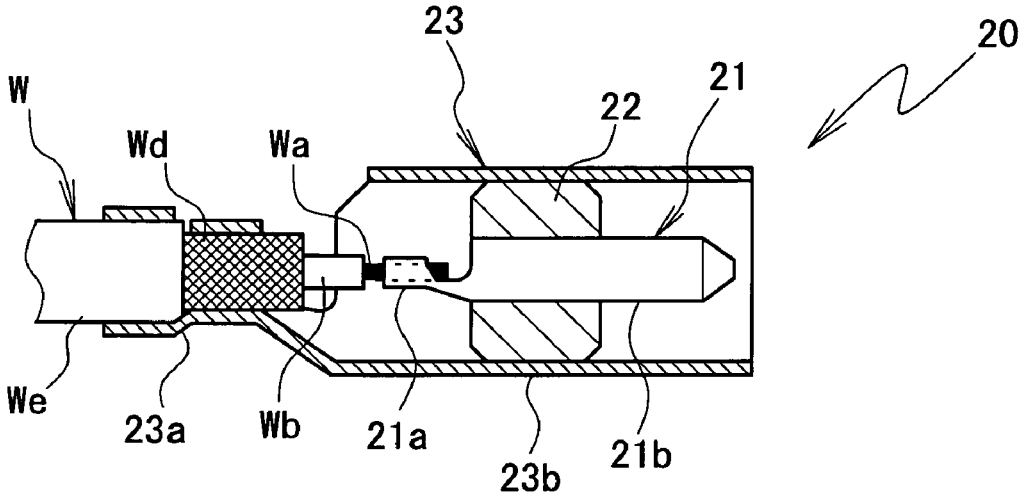
FIG. 9 is a longitudinal sectional view schematically showing a conventional shielded connector.

FIGS. 8A to 8C are views showing a modified example of FIGS. 7A to 7C and showing the process of crimping the connecting section crimping portion 5 onto the crimp section 2*a* of the inner conductor terminal 2 after being crimped. As shown in FIG. 8A, the space between the right and left terminal portions 5*b* and 5*c* of the connecting section crimping portion 5 is broadened upward from the bottom surface 5*a* of the connecting section crimping portion 5 toward their ends, and the terminal portions 5*b* and 5*c* are long enough to be wound around various diameter crimp sections of inner conductor terminals after being crimped. After the connecting section crimping portion 5 is crimped, the terminal portions 5*b* and 5*c* are provided with ring-shaped portions 5*d* and 5*e* being bent inward respectively, and the curved convex surfaces 5*f* and 5*g* of the ring-shaped portions 5*d* and 5*e* come into elastic contact with the crimp section 2*a* of the inner conductor terminal 2.

A description of the process of crimping the connecting section crimping portion 5 having the different outer diameter from those in FIGS. 1 and 4 will be given. First, as shown in FIG. 8A, the crimp section 2*a* of the inner conductor terminal 2 after being crimped is placed on the bottom surface 5*a* of the connecting section crimping portion 5. Then, the terminal portions 5*b* and 5*c* are bent inward by performing crimping thereon with a crimping device not shown, and brought into a state as shown in FIGS. 8B and 8C. At that time, the terminal portions 5*b* and 5*c* of the connecting section crimping portion 5 are bent inward to form the ring-shaped portion 5*d* and 5*e*, and the curved convex surfaces 5*f* and 5*g* of the ring-shaped portions 5*d* and 5*e* come into elastic contact with the crimp section 2*a* of the inner conductor terminal 2.

The connecting section crimping portion 5 after being crimped has a substantially heart shape in cross section having the height A3 and the width B3 as shown in FIG. 8B. The height A3 and the width B3 in cross section of the connecting section crimping portion 5 after being crimped are larger than the height A2 and the width B2 in cross section of the connecting section crimping portion 5 after being crimped shown in FIG. 5B according to the second preferred embodiment of the present invention, and the outer diameter of the crimp section 2*a* of the inner conductor terminal 2 after being crimped is enlarged to be closer to the outer diameter of the terminal section 2*b* of the inner conductor terminal 2 shown in FIG. 8C.

The outer diameter (the height A3 and the width B3) of the connecting section crimping portion 5 after being crimped can be made larger (see FIG. 7B) by forming the ring-shaped portion 5*d* being bent inward from the top side of the terminal portion 5*b* of the connecting section crimping portion 5 and performing crimping such that the ring-shaped portion 5*d* comes into elastic contact with the crimp section 2*a* of the inner conductor terminal 2 as shown in FIG. 7B when the connecting section crimping portion 5 is crimped onto and wound around the crimp section 2 of the inner conductor terminal 2 after being crimped.

In addition, the outer diameter (the height A3 and the width B3) of the connecting section crimping portion 5 after being crimped can be made larger (see FIG. 8B) by forming the ring-shaped portions 5*d* and 5*e* being bent inward from the top side of the terminal portion 5*b* of the connecting section crimping portion 5 and performing crimping such that the ring-shaped portions 5*d* and 5*e* come into elastic contact with the crimp section 2*a* of the inner conductor terminal 2 as shown in FIG. 8B when the connecting section crimping portion 5 is crimped onto and wound around the crimp section 2*a* of the inner conductor terminal 2 after being crimped.

In the conventional method of enlarging the outer diameter of the crimp section 2*a* by attaching a metal sleeve to the crimp section 2*a* of the inner conductor terminal 2 after being crimped, it is necessary to prepare metal sleeves of various sizes in order to deal with various types of shielded cables. In contrast, according to the preferred embodiments of the present invention, it is possible to obtain impedance matching in various types of shielded connectors and shielded cables only by preparing one connecting section crimping portion 5.

The foregoing description of the shielded connector according to the preferred embodiments of the invention is not intended to be exhaustive or to limit the invention to the precise form disclosed, and modifications and variations are possible in the light of the above teachings or may be acquired from practice of the invention. For example, though the preferred embodiments of the present invention as described above are such that a connecting section crimping portion is crimped onto a crimp section defining a connecting section of an inner conductor terminal to a signal conductor, the present invention is applicable to connecting sections such as a welded connecting section connected by welding and defining a connecting section to a signal conductor of an inner conductor terminal and a soldered connecting section connected by soldering and defining a connecting section of an inner conductor terminal to a signal conductor.

The invention claimed is:

1. A shielded connector for a shielded cable comprising a signal conductor, a shielded conductor, an insulator interposed between the signal conductor and the shielded conductor, and a sheath arranged to cover the shielded conductor, the shielded connector comprising:

an inner conductor terminal to be connected to the signal conductor; and an outer conductor terminal to be connected to the shielded conductor, which is arranged to house the inner conductor terminal interposing a dielectric between the outer conductor terminal and the inner conductor terminal, wherein the inner conductor terminal comprises an inner conductor terminal connecting section to be connected to the signal conductor, and a connecting section crimping portion made from a plate-shaped conductive material and arranged to enlarge an outer diameter of the inner conductor terminal connecting section is crimped onto and wound around the inner conductor terminal connecting section after being connected, the connecting section crimping portion comprises at one of terminal portions a ring-shaped portion being bent inward from a top side of the terminal portion and the ring-shaped portion comes into elastic contact with the inner conductor terminal connecting section when the connecting section crimping portion is crimped onto the inner conductor terminal connecting section.

2. A shielded connector for a shielded cable comprising a signal conductor, a shielded conductor, an insulator interposed between the signal conductor and the shielded conductor, and a sheath arranged to cover the shielded conductor, the shielded connector comprising:

an inner conductor terminal to be connected to the signal conductor; and an outer conductor terminal to be connected to the shielded conductor, which is arranged to house the inner conductor terminal interposing a dielectric between the outer conductor terminal and the inner conductor terminal, wherein the inner conductor terminal comprises an inner conductor terminal connecting section to be connected to the signal conductor, and a connecting section crimping portion made from a plate-shaped conductive material and arranged to enlarge an outer diameter of the inner conductor terminal connecting section is crimped onto and wound around the inner conductor terminal connecting section after being connected, the connecting section crimping portion comprises at one of terminal portions a ring-shaped portion being bent inward from a top side of the terminal portion and at the other terminal portion a ring-shaped portion being bent inward from a top side of the terminal portion and the ring-shaped portions come into elastic contact with the inner conductor terminal connecting section when the connecting section crimping portion is crimped onto the inner conductor terminal connecting section.

* * * * *